United States Patent [19]

Bouteiller

[11] Patent Number: 4,708,611

[45] Date of Patent: Nov. 24, 1987

[54] APPARATUS FOR CASTING AND INVERTING CONCRETE PRODUCTS

[76] Inventor: Harold L. Bouteiller, 32 Broughton Crescent, Red Deer, Canada, T4N 1C8

[21] Appl. No.: 847,209

[22] Filed: Apr. 2, 1986

[51] Int. Cl.[4] ..... B28B 7/08

[52] U.S. Cl. ..... 425/62; 249/86; 249/120; 249/129; 249/137; 249/158; 425/424; 425/439

[58] Field of Search ..... 425/62, 439, 432, 111, 425/424; 264/228; 249/86, 75, 137, 120, 124, 129, 158

[56] References Cited

U.S. PATENT DOCUMENTS

| | | | |
|---|---|---|---|
| 2,721,368 | 10/1955 | Landrum | 249/158 |
| 3,032,851 | 5/1962 | Gibbs | 425/439 |
| 3,190,607 | 6/1965 | Sonneville | 249/137 |
| 4,025,265 | 5/1977 | Auer | 425/439 |
| 4,038,355 | 7/1977 | Bratchell | 264/228 |
| 4,102,957 | 7/1978 | Da Re | 425/111 |
| 4,228,985 | 10/1980 | Gaudelli et al. | 249/137 |
| 4,242,071 | 12/1980 | Stinton | 264/228 |

FOREIGN PATENT DOCUMENTS

| | | | |
|---|---|---|---|
| 417291 | 7/1974 | U.S.S.R. | 249/183 |

*Primary Examiner*—Jay H. Woo
*Assistant Examiner*—James C. Housel
*Attorney, Agent, or Firm*—Newton, Hopkins & Ormsby

[57] ABSTRACT

An apparatus for making a plurality of formed concrete products. The apparatus comprises a platform having a series of mold cavities, wherein the platform is attached to a vibrator and a hydraulic lift system. The hydraulic lift system lifts and inverts the platform, molds, and cured concrete products for easy removal. The apparatus also comprises a reinforcing bar support system which suspends the reinforcing bars from tapered pins extending into the wet cement, thus eliminating the need for placing reinforcing bar supports on the bottom of the mold cavity.

14 Claims, 8 Drawing Figures

APPARATUS FOR CASTING AND INVERTING CONCRETE PRODUCTS

BACKGROUND OF THE INVENTION

1. Field of the Invention

This invention relates to the art of casting formed concrete products. More particularly, this invention relates to an apparatus and method for making a plurality of formed products at one time and providing a convenient means for removing the final products from their molds.

2. Description of the Prior Art

Concrete products such as bumper curbs, railroad ties, fence posts, and patio blocks are usually produced in molds that are large and cumbersome to handle. The molded products are usually made either one at a time or in a multi-cavity mold which requires at least two workers and additional heavy equipment for lifting and inverting the molds to remove the cured product. No single apparatus is available that is capable of forming multiple concrete products while also providing both a vibrating means and means for removing the final formed products.

For example, Gaudelli et al., in U.S. Pat. No. 4,228,985 discloses a mold bed having a number of mold cavities wherein the molded parts are readily removable by suspending the entire mold bed and formed products on a pedestal and turning the bed upside-down to eject the molded parts by gravity. Several disadvantages are inherent in this type of apparatus. First, the mold bed when filled with concrete is very heavy and it takes at least two men or a forklift to place it on the pedestals prior to inversion. Furthermore, should one desire to vibrate the wet cement mixture after it is poured into the molds, one would have to attach a separate vibrator system. Also, the Gaudelli et al. mold bed lacks versatility in that it can only be used for making elongated mold products such as concrete spacers used in parking lots.

Bratchell, U.S. Pat. No. 4,038,355 teaches combining a multi-cavity mold with a tilt device for lifting one side of the mold to pivot it about a longitudinal axis, lowering the mold, and inverting it in order to discharge the concrete ties formed therein. There are several disadvantages encountered with the production method disclosed in Bratchell. First, effective use of the tilt mold frame requires additional heavy machinery, for example mounting a separate vibrator on to the hopper which is filled with wet cement. Secondly, a forklift truck must be used to support the filled mold prior to the lifting and tilting steps. Also, in order to lift the mold frame containing the formed concrete ties, it is necessary to provide a hoist system which is attached to a crane.

As is evident from the above discussion of the prior art, what is needed is an apparatus capable of making a plurality of formed concrete products having all the necessary equipment for making the products incorporated into a single apparatus that can be operated by just one person with minimum manual effort.

SUMMARY OF THE INVENTION

A major objective of the present invention is to provide an apparatus for making a plurality of pre-cast concrete products of various types that can be operated by a single person.

Another major objective is to provide an apparatus having a vibrator means attached thereto for vibrating the mold forms containing the wet cement mixture.

Another objective of the present invention is to provide an apparatus having a lift means incorporated therein so that no external hoist system or forklifts are required for the removal of the formed concrete product from the molds.

A still further objective is to provide an apparatus having a vibrating platform that will accomodate a variety of mold patterns including but not limited to bumper curbs, patio blocks, fence posts, and railroad ties.

Another objective is to provide a tapered pin to be inserted into those molds that are used for making elongated concrete forms which will be anchored in place with steel pins or rods, and a convenient bayonet mount for removing the pins after the concrete has cured.

Another major objective is to provide a new reinforcement bar (rebar) support system which slideably mounts on to the tapered pins for suspending the reinforcing bars therefrom.

Another objective is to provide a movable apparatus having retractable wheels to enable the production of concrete products to be carried out either indoors or outdoors or actually on the job site.

It is yet another objective to provide a method and apparatus for making formed concrete products which is more efficient, less expensive, and ultimately reduces the production cost of the products.

Briefly, the apparatus of this invention comprises an essentially rectangular platform having two side edges, a front and back edge, a top and bottom surface, and a plurality of molds situated on the top surface of the platform either formed as an integral component of the platform itself or as a series of individually formed components which are removably attached to the top surface of the platform.

The supporting frame for the apparatus comprises two L-beams, one situated along each side edge of, and in an essentially parallel relationship to, the platform. Each L-beam has a rearwardly positioned vertically extending member, a horizontally extending member, and at least two inwardly projecting support beams hingedly attached to the horizontal member. Each support beam is capable of swinging upwardly and outwardly so that the inverted platform may rest on the floor for easy removal of the formed concrete products. The L-beams are connected by two connecting beams, the first one connecting the vertical members at the top and the second one connecting the vertical members at the bottom.

A means for lifting and inverting the platform is attached to the platform and the L-beams. Also, at least one motor-actuated vibrator is attached to the bottom surface of the platform.

A detachable retainer means is also included for temporarily securing the formed concrete products in the molds prior to removal, when the platform is in its inverted position.

The apparatus also includes upwardly projecting tapered pins in the molds to form correspondingly shaped holes in the formed concrete product. A reinforcing bar support system is adapted to slideably engage the upwardly extending tapered pins. The support system comprises a hollow cylinder having two radially outwardly projecting rods upon which the reinforcing bars rest. An internal stop is located inside the hollow cylinder to control the position of the support system relative to the tapered pin.

Briefly, the method of making a plurality of concrete products comprises the following steps:

(1) providing a plurality of molds on an essentially rectangular platform which is supported by a frame having a plurality of inwardly projecting hingedly attached support beams, the platform being attached to a hydraulically controlled lift system for lifting and inverting the platform and plurality of molds for removal of the formed concrete products;

(2) providing the platform with an attached vibrator means;

(3) forming a wet mixture of concrete;

(4) pouring the wet mixture of concrete into the molds;

(5) placing a retainer means across the tops of the molds for temporarily securing the formed product in the molds prior to removal when the platform is in its inverted position;

(6) vibrating the platform and the wet mixture within the molds to sift the finer and heavier particles within the wet mixture to the bottom of the molds and to eliminate any voids;

(7) allowing the concrete to cure;

(8) lifting the platform with a hydraulically controlled lift system;

(9) inverting the platform;

(10) rotating the hingedly attached support beams upwardly and outwardly;

(11) lowering the platform until the retainer means rests on the ground;

(12) detaching the retainer means; and

(13) raising the platform, leaving the formed concrete products on the ground.

DETAILED DESCRIPTION OF THE DRAWINGS

Figure 1:
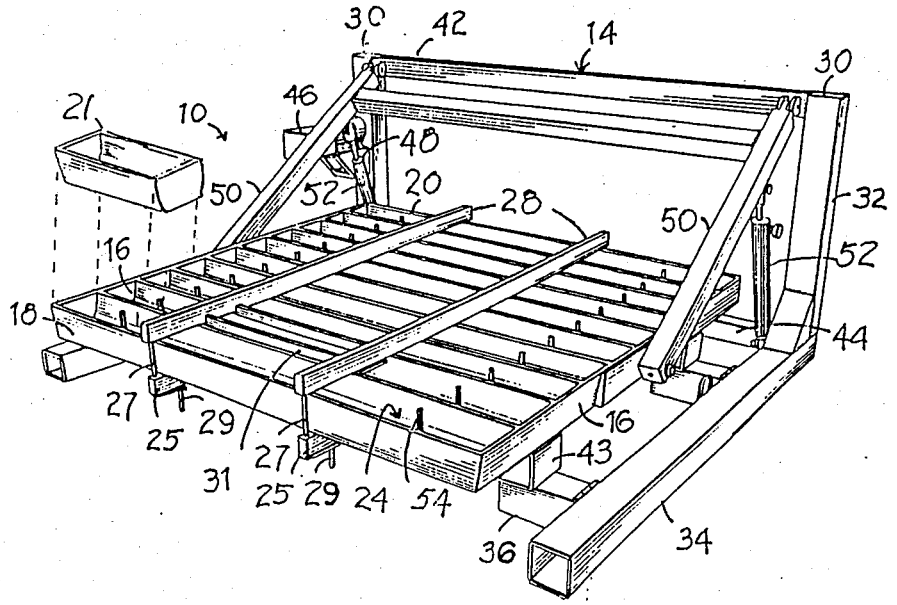
FIG. 1 is a perspective view of the concrete forming apparatus.
Figure 2:
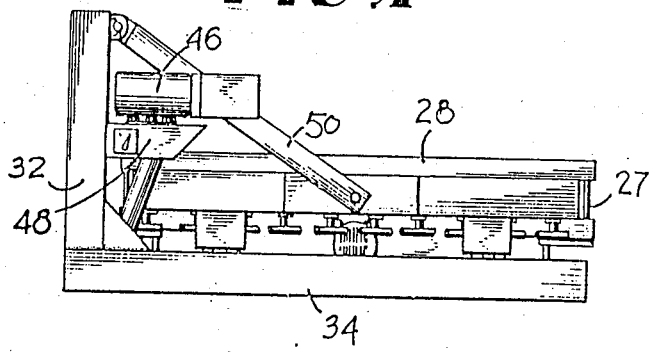
FIG. 2 is a side elevation of the apparatus showing the mold platform in an upright lowered position.

Referring now in detail to the drawings, one embodiment of molding apparatus 10 is illustrated in FIG. 1. In this embodiment, apparatus 10 is provided with a rectangular platform 12 mounted on frame 14.

Figure 8:
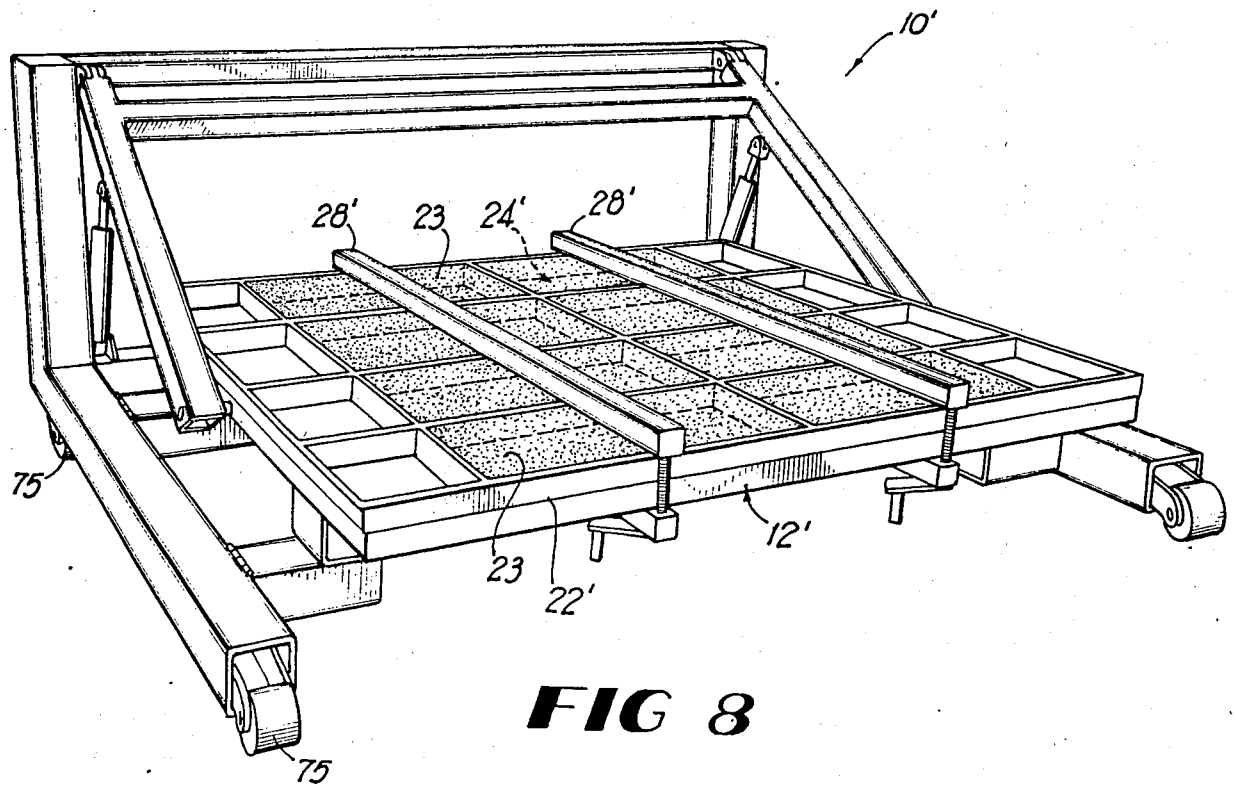
FIG. 8 is a perspective view of an alternate embodiment of the apparatus.

Platform 12 is made up of side edges 16, front edge 18, and back edge 20, and having a top surface 22 which, in the embodiment illustrated in FIG. 1, also serves as the bottom of mold cavities 24. Mold cavities 24 are formed as integral components of platform 12 by inserting and securing side walls 26 to extend longitudinally between side edges 16. An alternate construction for platform 12' and mold cavities 24' is illustrated in FIG. 8. In this alternate embodiment, platform 12' is manufactured separately as a flat planar surface so that individual mold forms may be attached to the top surface 22'. This enables one to use apparatus 10' for casting a variety of formed concrete products. For example, a tray having a plurality of longitudinal mold cavities, similar to that illustrated in FIG. 1, or patio block forms 23 as shown in FIG. 8, can be placed on top of platform 12' and secured thereto by retainer bars 28' or any other conventional means.

Referring back to the embodiment in FIG. 1, two retainer bars 28 are placed across the tops of mold cavities 24 and secured to cross bars 25 which extend across bottom surface 40 of platform 12 between back edge 20 and front edge 18. Cross bars 25 are held in place by vibrator housing 39 shown in FIG. 5. Retainer bars 28 and cross bars 25 have threaded shafts for receiving screw members 27 which are rotated into place by wheel crank 29. While the primary function of the retainer bars 28 is to temporarily secure the formed concrete products in the molds when platform 12 is in its inverted position, they also serve to maintain individually constructed molds in place when placed on top surface 22' of platform 12', as shown in FIG. 8. It may be necessary to vary the number and placement of retainer bars 28 and 28' depending upon the mold forms being used.

When bumper curbs are being made, void pans 31 may be attached to retainer bars 28 to provide an indentation in the formed bumper curb for water drainage. Also, end inserts 21 can be placed inside mold cavities 24 to produce bumper curbs of varying length.

Frame 14 supports platform 12 and is made up of two L-beams 30, one situated along each side edge 16 of platform 12 in an essentially parallel relationship thereto. Each L-beam 30 has a rearwardly positioned vertically extending member 32 and a horizontally extending member 34. At least two inwardly projecting hinged support beams 36 are attached to each L-beam 30 for supporting platform 12 above the ground to allow vibrators 38 enclosed in vibrator housing 39 and vibrator motor 41 to be attached to bottom surface 40 of platform 12 (see FIG. 5) so that they can vibrate freely without touching the ground. Platform blocks 43 are attached to bottom surface 40 of platform 12 and also function to support platform 12 at its proper height above the ground. L-beams 30 are connected by two connecting beams, the first connecting beam 42 extends between the top portions of vertical members 32 and the second connecting beam 44 extends between the bottom portions of vertical members 32. Additional connecting beams may be added should extra reinforcement of the frame structure be desired.

Figure 3:
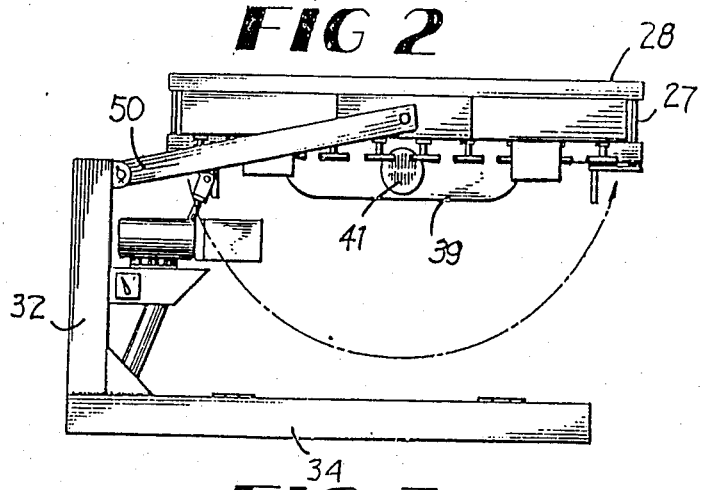
FIG. 3 is a side elevation of the apparatus showing the mold platform in an upright raised position.

Platform 12 is attached to a hydraulically controlled lift system consisting of an electric motor 46 located on mounting box 48 which is secured to vertical member 32 of L-beam 30. Two lift arms 50 are pivotally attached at each end to the first connecting beam 42 and side edges 16, one lift arm 50 being attached to each side edge 16 of platform 12. Each lift arm 50 is then attached to a hydraulic cylinder 52 which, when activated by electric motor 46, raises platform 12 to its elevated position, as illustrated in FIG. 3. The height attained must be sufficient to permit a 180° rotation of platform 12. Inversion of platform 12 is usually performed manually by grasping side edge 16 and rotating 180°. Rotation may be facilitated by attaching a steering wheel (not shown) to side edge 16 or by adding a second hydraulic system.

Figure 6:
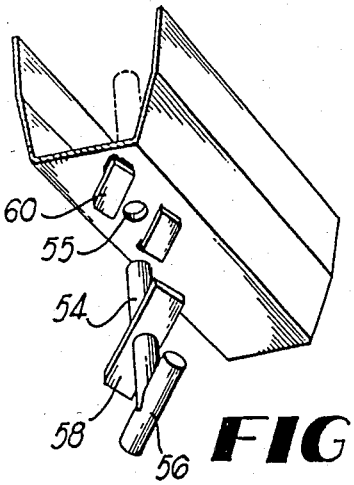
FIG. 6 is an enlarged perspective of the tapered pin bayonet mount.

When concrete bumper curbs are being molded, the final product often has two vertically extending holes for inserting rods to anchor the bumper curbs in place wherever they are being used, for example in parking lots or along the road side. These holes are formed by inserting at least two upwardly projecting tapered pins 54 into mold cavity 24, as shown in FIG. 1. After the concrete has been poured into the mold and allowed to cure, tapered pins 54 are removed. A bayonet mount release system has been found to be convenient for securing and removing tapered pins 54. As illustrated in FIG. 6, tapered pin 54 is constructed having a T-handle 56 for rotating and engaging locking plate 58 with locking tabs 60 which are attached to bottom surface 40 of platform 12.

Figure 7:
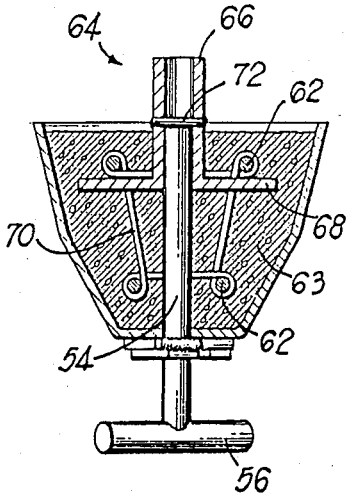
FIG. 7 is an enlarged cross-section of a mold cavity showing the reinforcing bar support system.

Many formed concrete products have inserted therein steel or metal reinforcing bars (rebars) to improve the strength of the formed product. Generally bumper curbs have four reinforcing bars 62 positioned within the formed product as illustrated in FIG. 7. The conventional way of suspending the rebars has been to insert either metal or concrete supports at the bottom of mold cavity 24 in order to keep the rebars 62 positioned centrally within the wet cement 63. The disadvantage with using metal supports is that rust spots appear as the top of the bumper curb wears away. When concrete supports are used, the top surface of the bumper curb eventually becomes irregular.

In order to avoid the problems of the prior art, a new rebar support system 64 has been designed and is illustrated in FIG. 7. Rebar support system 64 is made up of a hollow cylinder 66 having an internal diameter of a size sufficient to slideably engage tapered pin 54. Two radially projecting rods 68 extend outwardly from cylinder 66 and serve to support two rebars 62. To suspend additional rebars, wrapped wire 70 is looped around the rebars resting on rods 68 and then extended downwardly to loop around the additional rebars positioned in the mold. In order to assure proper positioning of rebars 62, internal stop 72 is inserted in cylinder 66 to allow support system 64 to assume the desired position relative to tapered pin 54. When the wet concrete 63 becomes partially cured, cylinder 66 is rotated 90° and slid upwardly out of the partially cured cement. Rebars 62 remain fixed in their location, as illustrated in FIG. 7.

In some instances, especially when molding fence posts for a noise barrier fence at the job site, it is convenient to be able to move apparatus 10 as the construction progresses. To this end, retractable wheels 75 can be attached to L-beams 30 as shown in FIG. 8. Wheels 75 also provide an easy means of moving apparatus 10 to the inside or outside depending on the weather.

Referring now to the method for making pre-cast concrete blocks, the following steps will describe a method of making bumper curbs using the molding apparatus 10, as illustrated in FIG. 1. In this embodiment, molding apparatus 10 is provided with a rectangular platform 12 which is supported by frame 14. A plurality of mold cavities 24, ten are illustrated in FIG. 1, are constructed as integral components of platform 12 wherein side edges 16 form the ends of mold cavities 24 and the front edge 18 forms one side of front cavity 24 and back edge 20 forms one side of back cavity 24. Nine side walls 26 are inserted therebetween at equal distances to form a total of ten cavities of equal size. Top surface 22 of platform 12 forms the floor for cavities 24. Each mold cavity 24 is provided with two holes 55 for receiving tapered pins 54 which are secured in place using a bayonet mount and T-handle 56, as illustrated in FIG. 6.

A hopper (not shown) is provided and filled with wet concrete which is discharged into the mold cavities 24, the hopper being moved across the tops of the molds until mold cavites 24 are filled.

Four rebars 62 are wrapped in support wire 70 in the configuration illustrated in FIG. 7 and then placed on rebar support systems 64 by suspending rebars 62 from the radially projecting rods 68.

Figure 5:
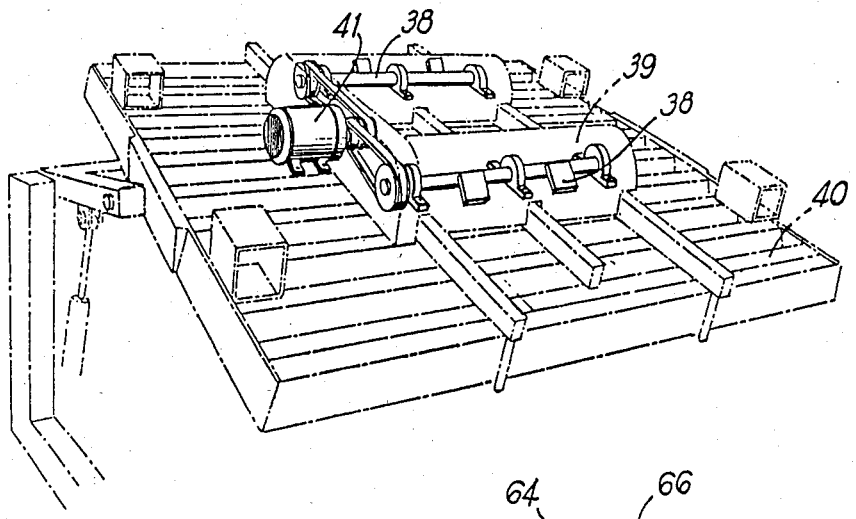
FIG. 5 is a partial perspective showing the bottom surface of the apparatus.

Vibrator motor 41, shown in FIG. 5, is activated by an on-off switch located on mounting box 48. The wet cement is vibrated within the molds for approximately 3 min. in order to settle the heavy and fine particles and to remove any air pockets trapped therein. After the vibrating step, rebar support system 64 is removed and the concrete is allowed to cure, generally overnight.

Figure 4:
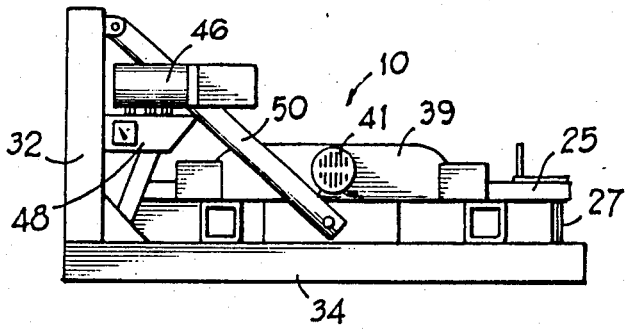
FIG. 4 is a side elevation of the apparatus showing the mold platform in an inverted lowered position.

After the concrete has cured, platform 12 is raised to its elevated position as shown in FIG. 3 and rotated either manually or mechanically by any conventional means to its inverted position as shown in FIG. 4. Tapered pins 54 are removed by rotating T-handle 56 until locking plate 58 is disengaged from locking tabs 60. Tapered pin 54 is then pulled upwardly using T-handle 56. Hinged support beams 36 are moved out of the way by rotating upwardly and outwardly until they rest on horizontal member 34 of L-beam 30. Platform 12 is then lowered until retainer bars 28 rest on the ground. Wheel crank 29 is turned to rotate screw member 27 from the threaded shafts of crossbar 25 and retainer bar 28 until screw member 27 is completely removed therefrom.

Platform 12 is then raised hydraulically, leaving the formed concrete bumper curbs on the ground. The bumper curbs are lifted onto a transport system for removal to a convenient place for storage.

Although the present invention has been illustrated and described in connection with the above embodiments, it will be understood that this is illustrative of the invention and is by no means restrictive thereof. It is reasonably expected that those skilled in the art can make numerous revisions and adaptations of the invention which is intended to be limited only by the appended claims.

What is claimed is:

1. An apparatus for making a plurality of molded concrete products comprising:

a support frame;

a platform having two side edges, a front and back edge, and a top and bottom surface;

a plurality of molds situated on the top surface of the platform, each mold having a cavity defined by side walls and a bottom for receiving concrete;

means for vibrating the platform and plurality of molds, the vibrator means being attached to and operatively associated with the platform;

motorized lift means pivotally attached to the support frame for lifting and inverting the platform and plurality of molds for removal of the formed concrete product, said lift means including a pair of arms each having a pair of opposite ends, each arm being pivotally mounted at one end to a respective one of said side edges of said platform and pivotally mounted at the opposite end to said support frame, said lift means further including means for raising said arms;

detachable retainer means for temporarily securing the formed concrete product in the molds prior to removal, when the platform is in its inverted position; and control means attached to the support frame for actuating the vibrator and lift means.

2. The apparatus of claim 1 wherein the plurality of molds are formed as integral components of the platform.

3. The apparatus of claim 1 wherein the plurality of molds comprise individually formed components removably attached to the top surface of the platform.

4. The apparatus of claim 1 wherein the vibrating means comprises at least one motor-actuated vibrator attached to the bottom surface of the platform.

5. The apparatus of claim 1 wherein the supporting frame comprises two L-beams, one situated along each side edge of and in an essentially parallel relationship to the platform, each L-beam having a rearwardly positioned vertically extending member, a horizontally extending member, at least two inwardly projecting support beams hingedly attached to the horizontal member, each support beam capable of swinging unpwardly and outwardly so that the platform may rest on the floor, and two connecting beams, the first one connecting the vertical members at the top, and the second one connecting the vertical members at the bottom.

6. The apparatus of claim 5 wherein each arm extends between the top connecting beam of the support frame and the approximate midsection of each side edge of the platform, the arms being pivotally mounted to the support frame at one end and rotatably mounted to the platform at the other end.

7. The apparatus of claim 1 wherein the means for raising said arm comprises a hydraulically controlled lift system wherein a hydraulic cylinder is attached to each arm.

8. The apparatus of claim 1 wherein the detachable retainer means comprises at least two retainer bars extending between the front and back edges of the platform and across the tops of the molds and a means for attaching the retainer means to the platform.

9. The apparatus of claim 1 wherein the mold cavities are elongate and rectangular in shape, the side walls extending between the side edges of the platform and wherein the side edges of the platform project upwardly to form the end walls of the mold cavities.

10. The apparatus of claim 9 further comprising end inserts for producing formed products of varying length.

11. The apparatus of claim 9 further comprising each mold cavity having at least two upwardly projecting tapered pins to form correspondingly shaped holes in the formed concrete product.

12. The apparatus of claim 11 further comprising a reinforcing bar support system having a hollow cylinder so dimensioned as to slideably engage the upwardly extending tapered pins, two radially outwardly projecting rods upon which reinforcing bars rest, and an internal stop located inside the hollow cylinder to control the position of the support system relative to the tapered pins.

13. The apparatus of claim 1 further comprising the support frame having a plurality of wheels to facilitate moving the apparatus to any desired location.

14. An apparatus for making a plurality of molded concrete products comprising:

a support frame;

a vibrating platform having two side edges, a front and back edge, and a top and bottom surface;

a mold tray situated on top surface of the platform having a plurality of molds, each mold having a cavity defined by side walls and a bottom for receiving concrete, said bottom of said mold tray being the top surface of said platform;

means for vibrating the platform and mold tray, the vibrator means being attached to and operatively asociated with the platform;

motorized lift means pivotally attached to the support frame for lifting and inverting the mold tray for removal of the formed concrete products, the lift means being adapted to releasably engage the mold tray, said lift means including a pair of arms each having a pair of opposite ends, each arm being pivotally mounted at one end to a respective one of said side edges of said platform and pivotally mounted at the opposite end to said support frame, said lift means further including means for raising said arms;

detachable retainer means for temporarily securing the formed concrete products in the mold cavities prior to removal, when the mold tray is in its inverted position; and control means attached to the apparatus for actuating the vibrator and lift means.

* * * * *